US008640632B1

(12) United States Patent
Odle et al.

(10) Patent No.: US 8,640,632 B1
(45) Date of Patent: Feb. 4, 2014

(54) UTILITY PAD WITH INTEGRATED SECURITY CAGE

(75) Inventors: Jared A. Odle, Melbourne, FL (US); Adrian N. A. Elliott, Viera, FL (US); Kyle J. Mulligan, Melbourne, FL (US); Mason J. Verbridge, Williamson, NY (US); Benjamin Z. Kolodner, Oldsmar, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 0 days.

(21) Appl. No.: 13/491,888

(22) Filed: Jun. 8, 2012

(51) Int. Cl.
*B65D 19/38* (2006.01)

(52) U.S. Cl.
USPC ..... 108/55.5; 108/57.2; 248/678

(58) Field of Classification Search
USPC ..... 108/55.1, 55.3, 55.5, 57.2, 57.25, 108/57.28; 248/346.01, 346.02, 346.03, 248/346.06, 346.2, 346.5, 678, 680–681
See application file for complete search history.

(56) References Cited

U.S. PATENT DOCUMENTS

| | | | | | |
|---|---|---|---|---|---|
| 4,829,909 | A * | 5/1989 | Mandel | 108/55.5 |
| 5,549,341 | A * | 8/1996 | Chase et al. | 294/68.1 |
| 5,575,389 | A * | 11/1996 | Alspach et al. | 206/386 |
| 5,728,458 | A | 3/1998 | Sweeney | |
| 5,950,980 | A | 9/1999 | Folmar | |
| 5,961,093 | A | 10/1999 | Jones et al. | |
| 7,334,421 | B1 | 2/2008 | Cantolino et al. | |
| 7,748,540 | B2 * | 7/2010 | Matsumoto et al. | 206/597 |
| 2004/0221776 | A1 | 11/2004 | Martin | |
| 2005/0247851 | A1 * | 11/2005 | Kessler et al. | 248/678 |
| 2009/0241461 | A1 * | 10/2009 | Linares | 52/592.1 |
| 2010/0207004 | A1 * | 8/2010 | Hermans et al. | 248/346.01 |
| 2010/0320360 | A1 * | 12/2010 | McLeod | 248/678 |
| 2011/0061572 | A1 * | 3/2011 | Liu et al. | 108/55.5 |

OTHER PUBLICATIONS

Chapter 16, Section 1609 of the Florida Building Code, "Buildings, structures, and parts thereof shall be designed to withstand the minimum wind loads . . . determined in accordance with Chapter 6 of ASCE 7".

* cited by examiner

*Primary Examiner* — Hanh V Tran

(57) ABSTRACT

A utility pad arrangement for mounting outdoor equipment such as air conditioner condensers thereon, having a flat, plate-like pad body with a plurality of recesses around its periphery. Mounting devices are provided and are shaped to nest within the recesses for optionally adding a security cage formed out of strap-like bars to securely surround the equipment located on the pad body in association with the mounting devices.

13 Claims, 8 Drawing Sheets

UTILITY PAD WITH INTEGRATED SECURITY CAGE

BACKGROUND AND SUMMARY OF THE INVENTION

The present invention relates to a utility pad for mounting air conditioner condensers and the like, and more particularly, to an improved utility pad with mounting features provided for an integrated security cage.

It is typical to install air conditioner condensers and other outdoor equipment atop utility pads in order to comply with regulations mandating that such equipment must be elevated to a specified minimum height above the adjoining grade. The heights specified by these regulations can range from 2 inches up to 3½ A inches. While the utility pads that exist to meet them vary extensively in both material composition and configuration, they have several inherent deficiencies. For example, most plastic pads lack sufficient strength to prevent cracking and UV degradation and are prone to sink to the ground over time. Pre-manufactured concrete composite pads tend to break during transportation and installation, their cementious exterior is susceptible to cracking from moisture penetration and vibration, and their inherent weight renders them difficult to handle and install by one person. Custom-poured concrete slabs require significant time and effort to prepare and construct, and take many hours to cure completely. There is no known pre-manufactured utility pad that offers the handling and installation advantages of lightweight construction without significantly compromising structural integrity.

Another increasingly common trend pertaining to outdoor air conditioner condensers is the installation of lockable security cages. These cages are designed to deter and/or prevent the theft of the copper tubing and other valuable components that can be found inside an air conditioner condenser. While most are comprised of hollow square steel tubing, security cages span a wide range of shapes, sizes, and levels of complexity. Their most prevalent deficiencies are their weak thin-walled structure, tedious and time-consuming installation, and lack of maintenance access. There are no known security cages that combine robust construction with simple, rapid installation. Furthermore, despite the broad assortment of utility pads and security cages, and that they are invariably affixed together, there are no known utility pads that incorporate mounting features for a corresponding integrated security cage, and inversely, there are no known security cages that incorporate mounting features for a corresponding, integrated utility pad.

An object of the present invention is to provide a utility pad that incorporates mounting features for a corresponding integrated security cage. In a currently preferred embodiment, the utility pad is formed from a lightweight composite material capable of withstanding the conditions of an outdoor environment and has sufficient strength to support an air conditioner condenser or similar equipment in an elevated position. Further included in the pad are recesses that allow concrete blocks or another type of ballast to be housed within and secured to the pad to increase the pad's total mass. This allows the pad to be easily installed by a single person and meet wind speed regulations applicable in specified areas of certain coastal states while retaining the benefits of its lightweight composition in areas without wind speed regulations. Further included in the pad is a horizontal perimeter flange to reduce the total soil bearing pressure from the equipment and the pad to prevent sinking. Finally included in the pad are multiple cavities designed to receive and secure mounting features for use with a corresponding, integrated security cage. The amount and spacing of these cavities allow the pad's mounting features to be installed such that the length and width of the security cage can be adjusted to best conform to the length and width of the particular equipment installed to the pad.

Another aspect of the present invention is to provide at least four mounting features on or within the utility pad to receive and secure a corresponding, integrated security cage. The pad's mounting features are configured to nest inside of those pad cavities that best conform to the length and width of the particular equipment installed to the pad. The pad's mounting features are also configured such that neither they nor the security cage can be easily removed when the cage is set in its locked configuration. The pad's mounting features advantageously facilitate simple, rapid removal of the security cage once the cage is unlocked without interfering with the equipment or the surrounding environment.

Another object of the present invention is to provide a security cage that incorporates mounting features for a corresponding integrated utility pad. In a currently preferred embodiment, the cage is comprised of a series of solid steel, or equivalent high strength material, bars to provide superior cutting resistance than conventional hollow tubing provides. These bars are protected with an anti-corrosion coating to inhibit rust formation. Included in the security cage of the present invention are at least four lower bars that extend vertically upward from the base and incorporate mounting features that are configured such that neither the cage nor the utility pad's mounting features can be easily removed when the cage is set in its locked configuration. The cage's mounting features are also configured to facilitate simple, rapid installation and removal of the security cage when it is unlocked without interfering with the equipment or the surrounding environment. Further included in the cage are at least four upper bars that are attached to the lower bars and extend vertically upward before bending toward the center of the pad to enclose the equipment. The cage's upper bars contain multiple connection points to allow its length, width, and height to be adjusted to best conform to the length, width, and height of the particular equipment installed to the pad, and are secured to the lower bars with security fasteners. The cage also includes a locking mechanism located at the central junction of the upper bars that allows for simple, rapid addition and removal of the locking mechanism and acts to reduce overall looseness by tightening the bars when the cage is set in its locked configuration.

Yet another object of the present invention is to provide retaining sleeves that can be attached to the aforementioned utility pad's mounting features. The pad's mounting features are configured such that they can be easily attached to any existing utility pad by simply changing the type of fasteners used. In this condition, the pad's mounting features rest above the existing pad's top surface, since existing pads do not contain the aforementioned cavities that allow the pad's mounting features to nest inside. The retaining sleeves are designed to allow the pad's mounting features to nest inside thereby allowing the security cage to function effectively when installed to existing utility pads.

BRIEF DESCRIPTION OF THE DRAWINGS

These and other aspects, objects, and features of the present invention will be understood and appreciated by those skilled in the art upon studying the following detailed description when taken in conjunction with the appended drawings wherein.

DETAILED DESCRIPTION OF THE DRAWINGS

Figure 1:
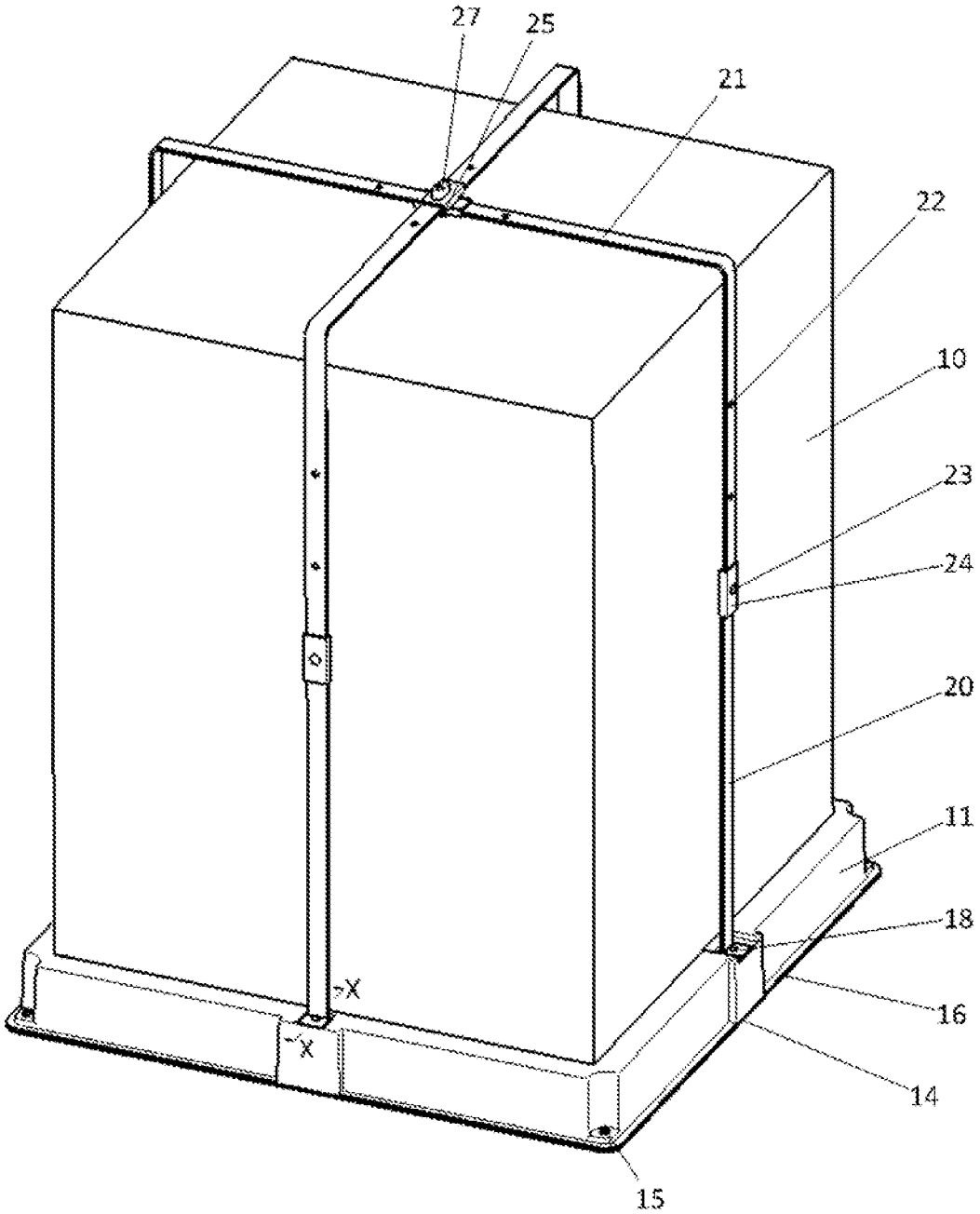
FIG. 1 is a perspective view of the security cage installed to its corresponding, integrated utility pad of the present invention set in its locked configuration enclosing representative outdoor equipment.

For purposes of the following description, the terms "upper," "lower," "right," "left," "rear," "front," "vertical," "horizontal," and derivatives thereof shall relate to the security cage and utility pad as oriented in FIG. 1. However, it is to be understood that the present invention may assume various alternative orientations, except where expressly specified to the contrary. It is also to be understood that specific dimensions and other physical characteristics relating to the embodiments disclosed herein are not to be considered as limiting unless the claims expressly state otherwise.

Referring now specifically to FIGS. 1, 4, 5, 6, 7, and 8, the reference numeral 10 generally designates an air conditioner condenser or other outdoor equipment of varying shape, size, and mass. FIG. 1 depicts the utility pad 11 and security cage components 20-27 set to their installed and locked configuration enclosing the air conditioner condenser or similar equipment 10.

Figure 2:
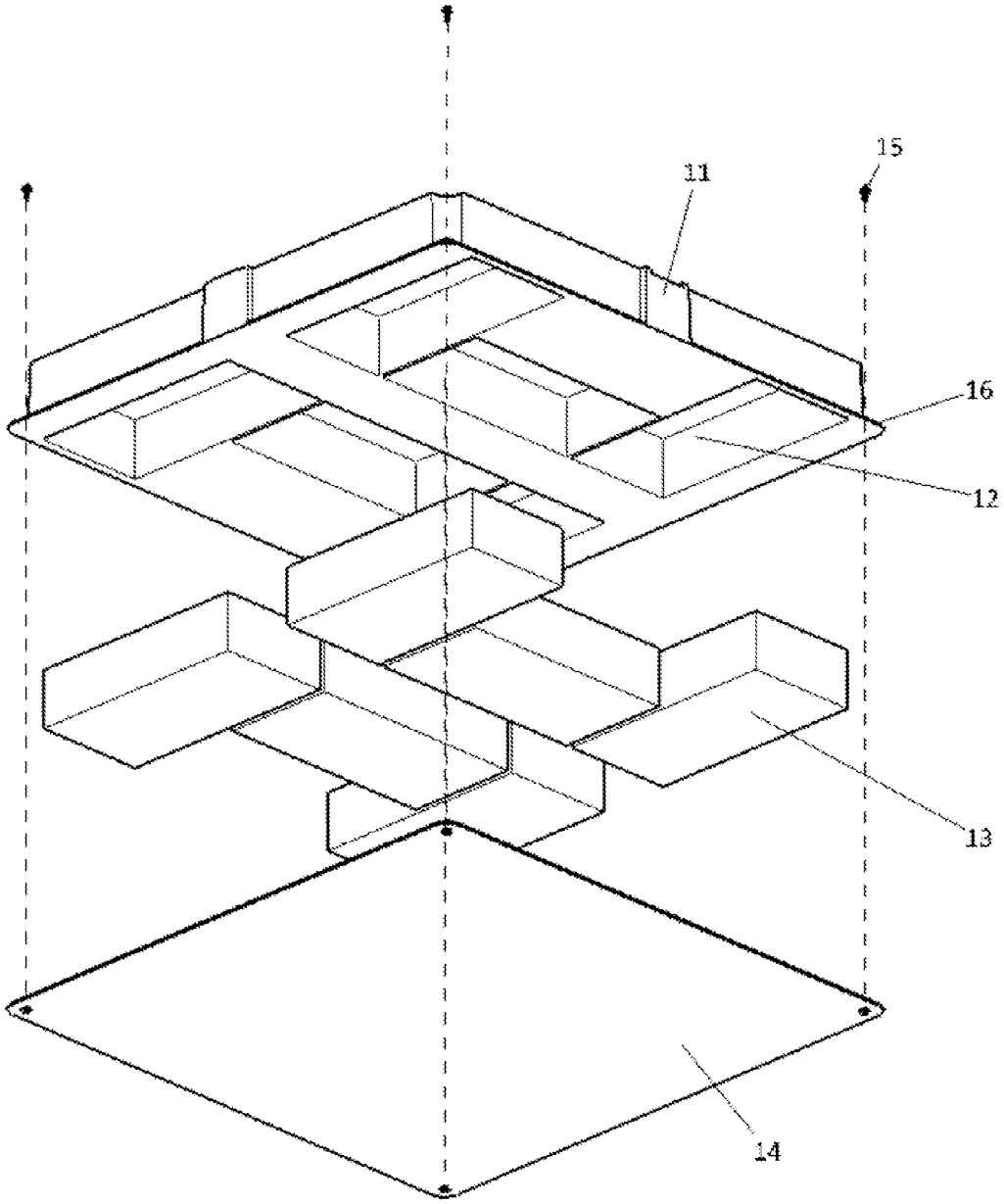
FIG. 2 is perspective exploded view of one side of the utility pad of the present invention illustrating the positioning and securing of the ballast material inside the pad's recesses.

The utility pad 11 is formed from a lightweight composite material with sufficient strength to support the air conditioner condenser or similar equipment 10 in an elevated position. In its currently preferred embodiment, the pad 11 is composed of a fiberglass reinforced polyolfinic thermoplastic composite material formed using conventional processes that are characteristic of injection and compression molding. The material selected shall be capable of withstanding the hazards of an outdoor environment including extreme temperature fluctuations as well as water, chemical, and UV exposure as will be known to those of ordinary skill in this art. The pad 11 is molded such that its top surface has a rough, non-skid texture to deter the equipment 10 from sliding across the pad upper surface. While the above-described pad 11 is constructed such that its size, shape, and strength characteristics are sufficient to comply with most areas' building regulations for outdoor equipment, it does not as such comply with wind speed regulations applicable in specified areas of certain coastal states in this lightweight configuration. These regulations contain provisions to prevent outdoor equipment 10 from becoming wind-borne debris as a result of strong wind gusts. One provision is that outdoor equipment 10 must be secured to the utility pad with tie-down straps. According, for example, to Chapter 16, Section 1609 of the Florida Building Code, "Buildings, structures, and parts thereof shall be designed to withstand the minimum wind loads . . . determined in accordance with Chapter 6 of ASCE 7," which vary depending on the prescribed basic wind speed of the area where the structure is located. As depicted in FIG. 2, one or more recesses 12 are provided in the configuration of the pad 11 to allow one or more articles of ballast material 13, such as concrete blocks, to be secured to the pad 11, when required, in order to sufficiently increase its overall mass when installed in an area with applicable wind speed regulations. By securing the equipment 10 and sufficient ballast material 13 to the pad 11, the combined masses of the equipment 10, pad, 11, and ballast material 13 produce a stabilizing moment that predominates the moment generated by the wind loads acting to overturn the structure, thus preventing it from tipping or sliding and becoming wind-borne debris. Since the mass of the ballast material 13 is divided among multiple blocks, it can be easily handled and secured by a single person. In the currently preferred embodiment, the ballast material 13 is held firmly inside the recesses 12 by a closeout panel 14 which in turn is secured to the pad 11 with fasteners 15.

Figure 3:
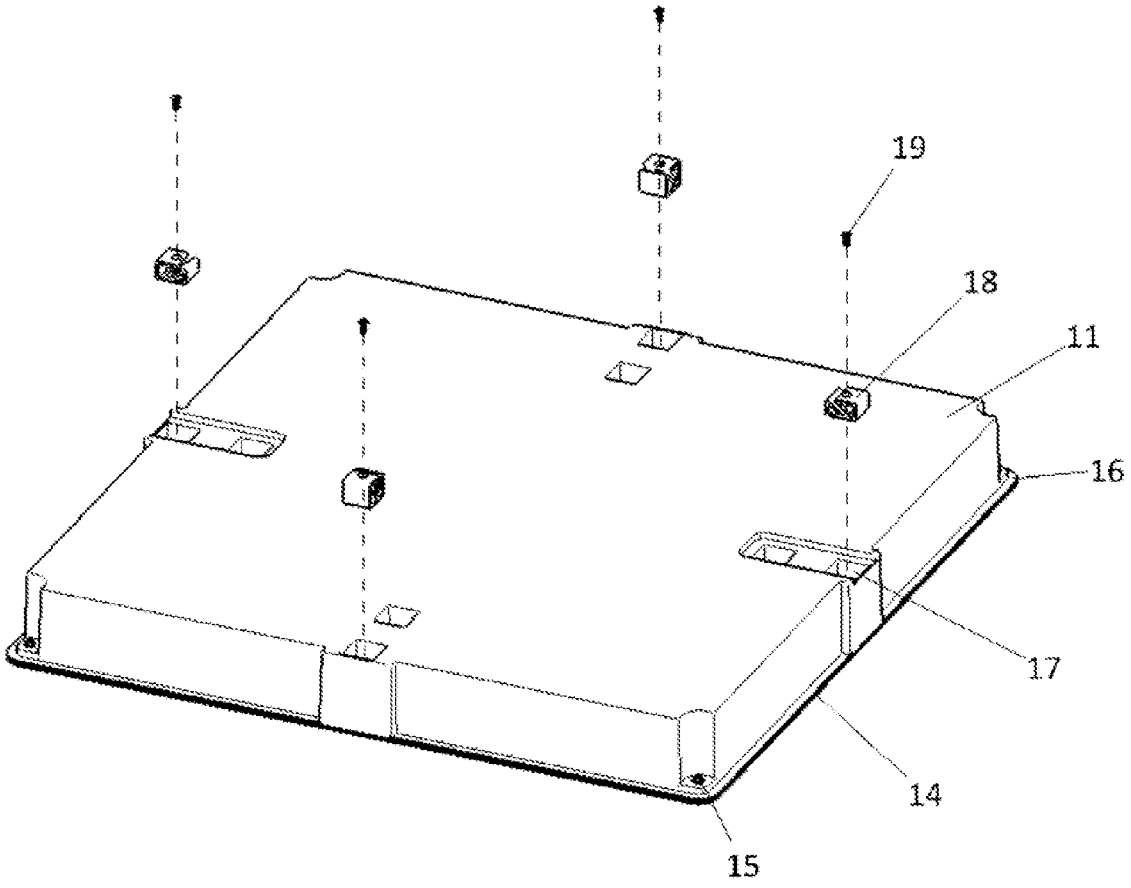
FIG. 3 is a perspective exploded view of the opposite side of the utility pad of the present invention illustrating the positioning and securing of the pad's mounting features inside the pad's cavities.

As depicted in FIGS. 2 and 3, the pad 11 includes a horizontal flange 16 that extends outward around the majority of its lower perimeter. In its lightweight configuration without the closeout panel 14, the purpose of the flange 16 is to sufficiently reduce the soil bearing pressure of the pad 11 to prevent it from sinking into the ground as a result of the weight and recurring vibration of the air conditioner condenser or other equipment 10. Also formed into the structure of the pad 11 are multiple cavities 17 configured to allow at least four mounting devices 18 to be secured to the pad. These cavities 17 exceed the number of mounting devices 18 and are spaced such that they provide multiple attachment locations, thereby allowing length and width of the security cage components 20-27 to be adjusted to best conform to the length and width of the particular equipment 10 installed to the pad 11. In addition, each cavity 17 is sized and configured to fully enclose its mounting device 18, which would be otherwise exposed on each side, thereby preventing the security cage components 20-27 from being easily removed when set in a locked configuration.

Figure 4:
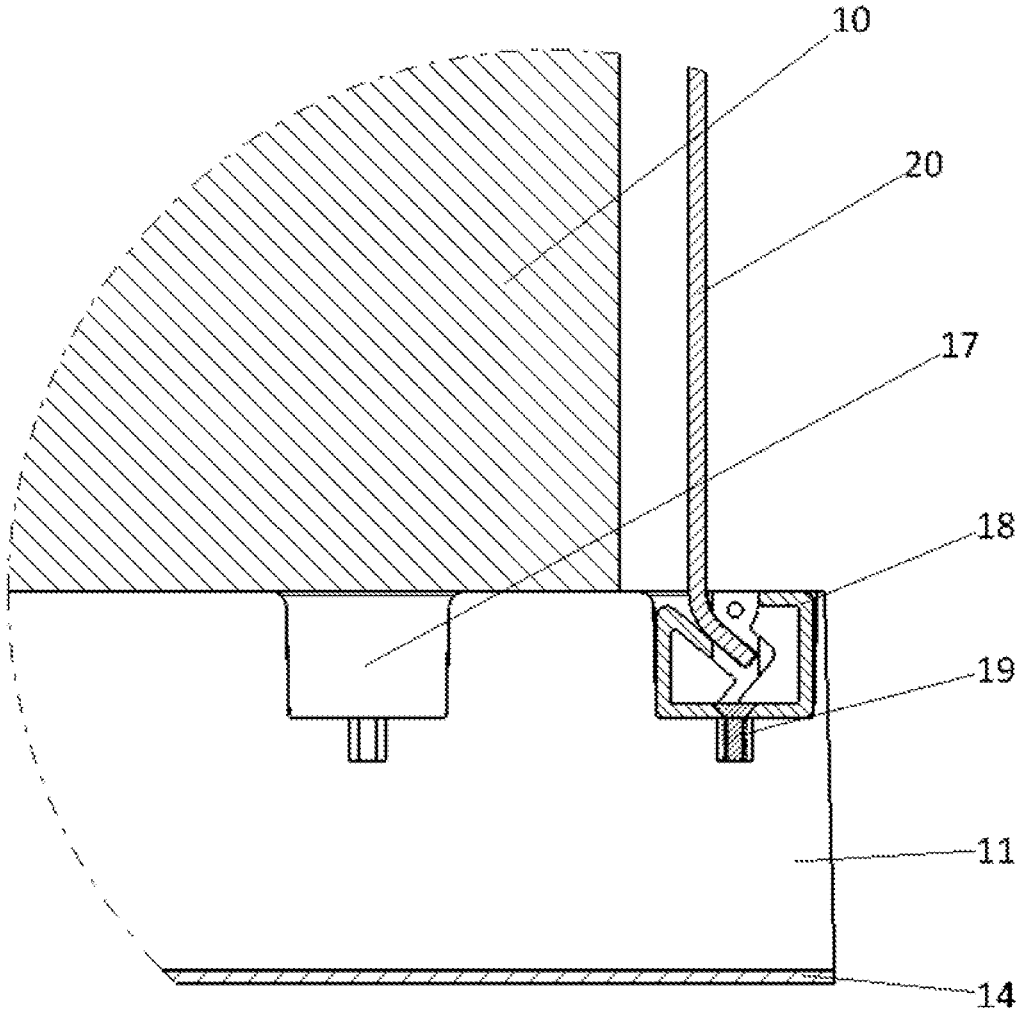
FIG. 4 is an isolated cross-sectional view of the utility pad and security cage in the area where the cage is affixed to the pad's mounting features taken along the line X-X of FIG. 1.

FIG. 4 illustrates how the mounting devices 18 nest inside the cavities 17 and are secured to the pad 11 with conventional fasteners 19. The mounting devices 18 are configured to allow access to the fasteners from overhead as long as the security cage's lower bars 20 are not attached. Once the lower bars 20 are affixed to the pad's mounting devices 18, however, the fastener 19 can no longer be accessed, thereby preventing the mounting devices 18 from being easily removed from the pad 11 when the assembled cage 20-27 is set in its locked configuration. Furthermore, the pad's mounting devices 18 and the cage's lower bars 20 are configured to precisely fit together and prevent the assembled security cage 20-27 from moving forward, rearward, upward, and downward when it is set in its locked configuration. These mounting devices 18 and the aforementioned cavities 17, which prevent the lower bars 20 from moving side to side, account for all six degrees of freedom, thereby preventing the security cage components 20-27 from being easily removed when in the locked configuration. Conversely, the pad's mounting devices 18 and the cage's lower bars 20 facilitate simple, rapid removal of the security cage 20-27 without interfering with the equipment 10 or the surrounding environment once it is unlocked.

Figure 5:
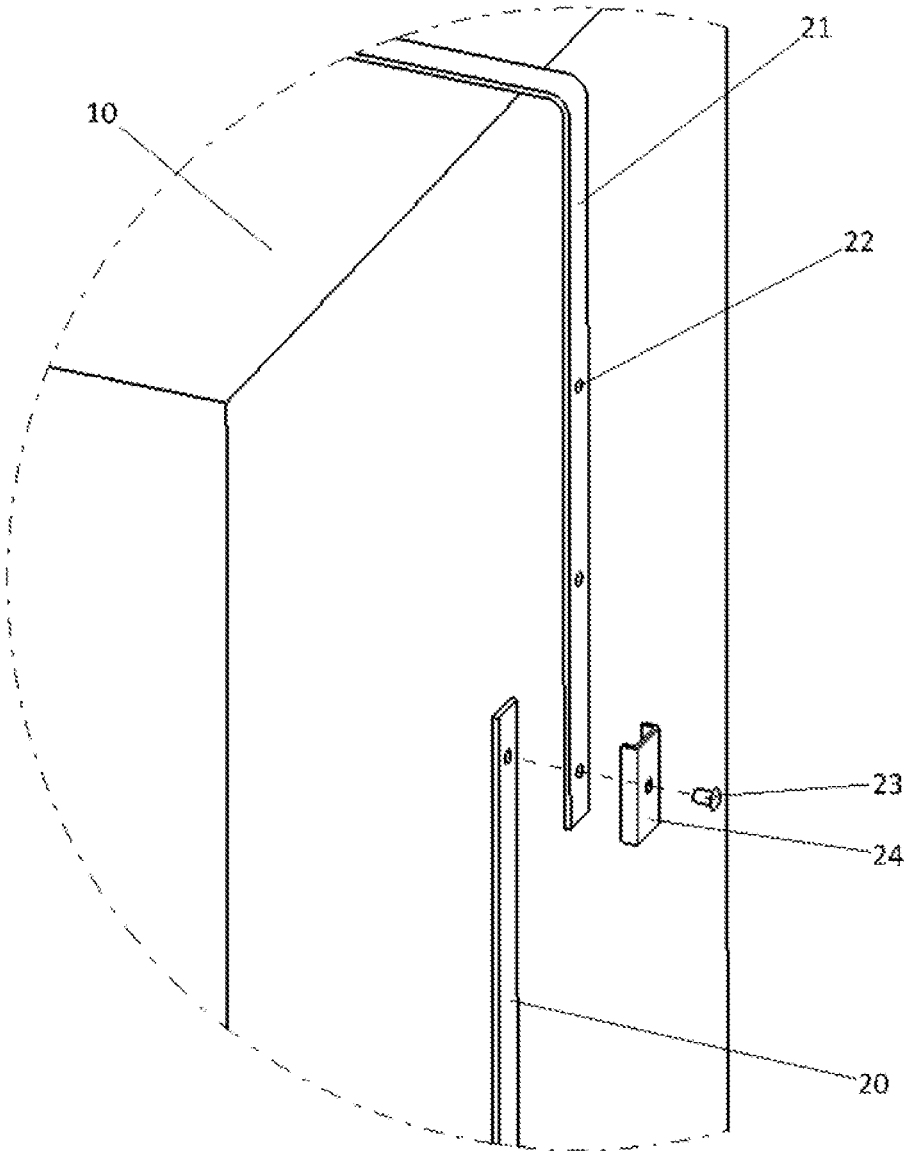
FIG. 5 is an isolated perspective exploded view of the security cage of the present invention shown in FIG. 1 illustrating the positioning and securing of one of the lower bars to one of the upper bars.
Figure 6:
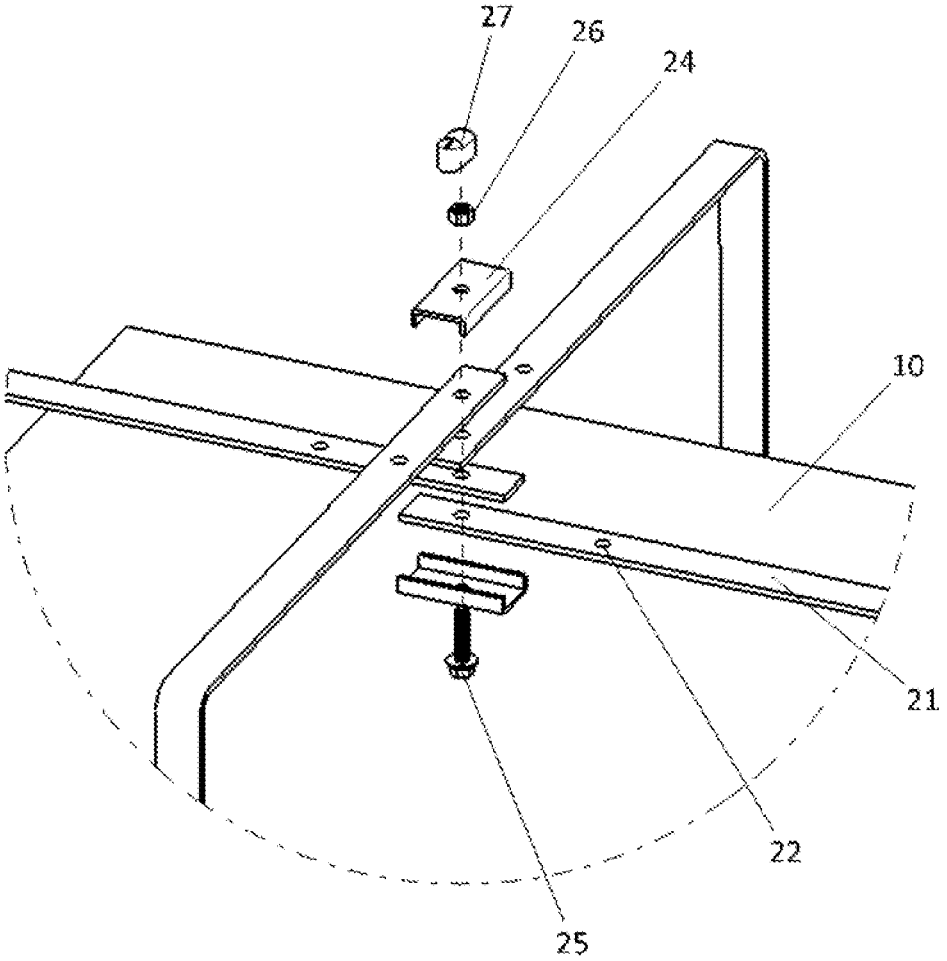
FIG. 6 is an isolated perspective exploded view of the security cage shown in FIG. 1 illustrating the positioning and securing of the upper bars and the locking mechanism.

FIGS. 5 and 6 depict the individual components 20-27 that comprise the security cage. The majority of the security cage is comprised of at least four of the aforementioned lower bars 20 (two of which are shown in FIG. 1) and at least four upper bars 21. These bars are composed of solid steel or equivalent high strength material to provide superior cutting resistance than the hollow tubing typical of existing security cages. Additionally, these bars 20, 21 are protected with an anti-corrosion coating to inhibit rust formation. Each lower bar 20 extends vertically upward until it eventually reaches and partially overlaps each upper bar 21. Each upper bar 21 partially overlaps each lower bar 20 and extends vertically upward before bending toward the center of the pad 11, then extends horizontally until it eventually reaches and partially overlaps its opposing bar, thereby completely enclosing the equipment 10. Each upper bar 21 contains multiple connection points 22 along its vertical and horizontal length. Multiple connection points 22 along the vertical face of each upper bar 21 allow its resultant installed height to vary depending on which connection point 22 is selected for attachment to the lower bar 20. This variable height capability thereby allows the overall height of the security cage components 20-27 to be adjusted to best conform to the height of the particular equipment 10 installed to the pad 11. Once the desired height location is selected, each upper bar 21 is secured to each lower bar 20 with a security fastener 23, as seen in FIG. 5, to prevent the bars from being easily disconnected. Each connection between the upper bars 21 and lower bars 20 is additionally reinforced with an alignment sleeve 24 that acts to prevent the bars from rotating with respect to each other. Multiple connection points 22 along the horizontal face of each upper bar 21, whose positions correspond to the pad's aforementioned cavities 17, allow its resultant length or width to vary depending on which cavity 17 is selected to secure the mounting features 18 to the pad 11. This variable length and width capability thereby allows the overall length and width of the security cage components 20-27 to be adjusted to best conform to the length and width of the particular equipment 10 installed to the pad 11.

FIG. 6 depicts the central junction of the upper bars 21 and illustrates the manner in which the upper bars are secured together. As was previously described for each side connection point, each pair of upper bars 21 is reinforced with an alignment sleeve 24 at the central junction that acts to prevent the bars from rotating with respect to each other. A compression-style fastener arrangement, such as a bolt 25 and nut 26, ties all of the upper bars 21 and alignment sleeves 24 together. This fastener arrangement 25, 26, once tightened, applies constant pressure at the central junction, which acts to reduce overall looseness. Located at the top of the central junction is the locking mechanism 27, or an equivalent mechanism to secure the bars, which encloses the upper end of the fastener arrangement 25, 26. The locking mechanism 27 prevents the security cage 20-27 from being easily removed when it is set in its locked configuration, while also allowing simple, rapid removal of the assembled cage 20-27 once unlocked.

Figure 7:
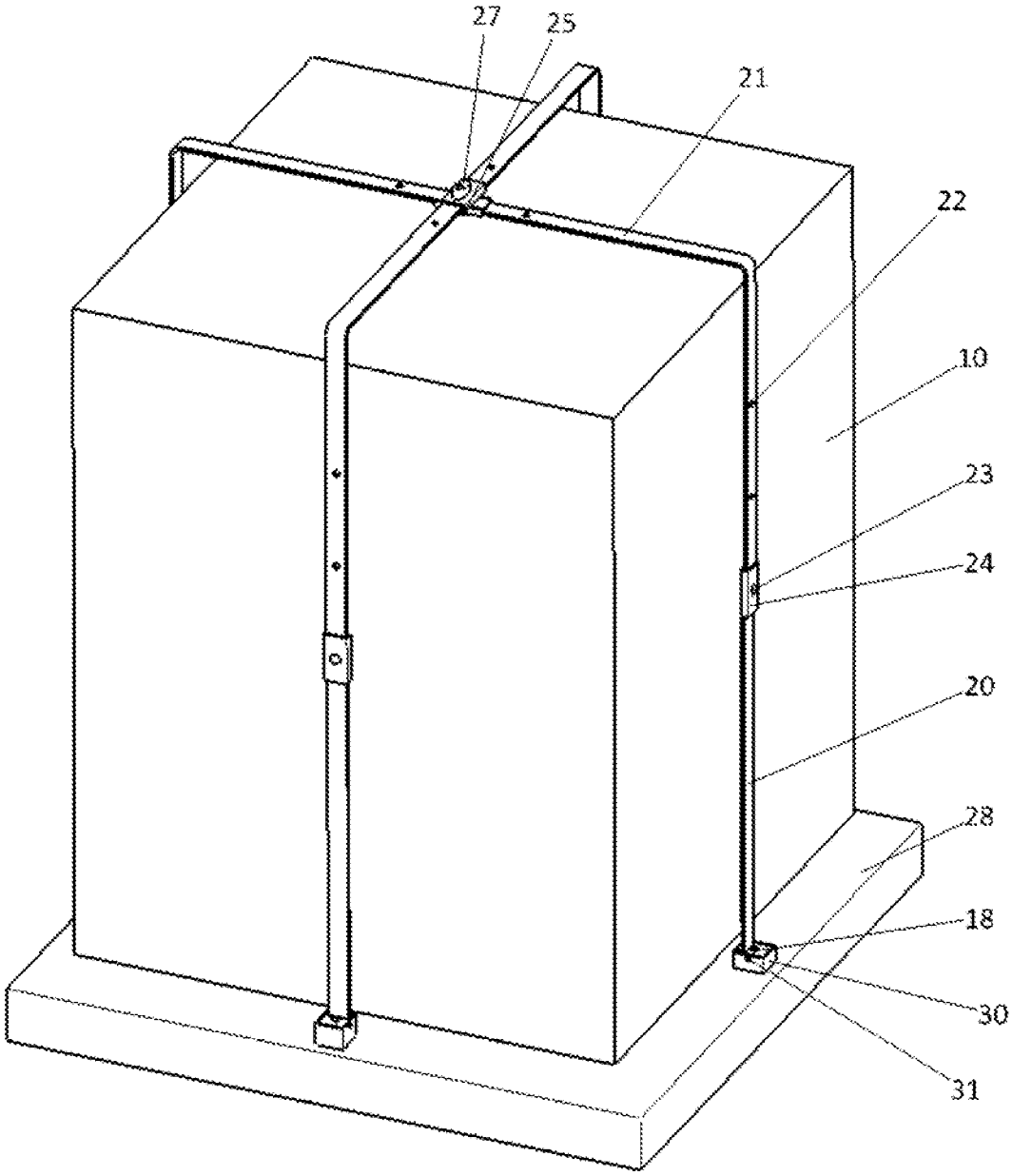
FIG. 7 is a perspective view of the security cage similar to that shown in FIG. 1 but installed at an existing utility pad set in its locked configuration enclosing an air conditioner condenser or similar equipment.
Figure 8:
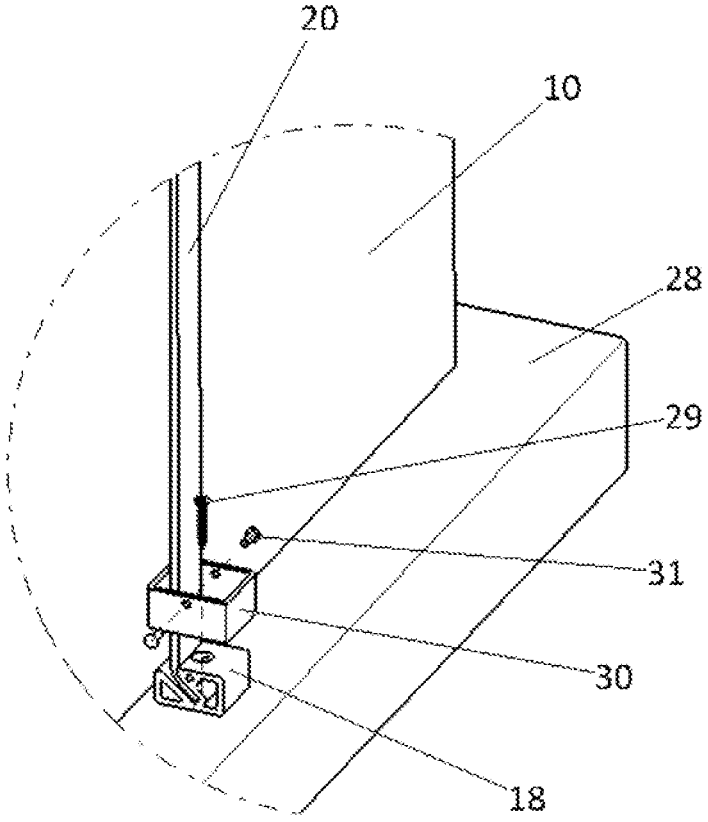
FIG. 8 is a perspective exploded view of an existing utility pad and security cage shown in FIG. 7 illustrating the positioning and securing of one of the retaining sleeves to one of the pad's mounting features, as well as the positioning and securing of one of the pad's mounting features to an existing utility pad.

As depicted in FIG. 7, the present invention also provides the capability for the security cage components 20-27 to be retrofitted to any existing pad 28. The aforementioned mounting devices 18 are placed on top the existing pad 28 and are spaced such that their length and width correspond to one of the length and width settings of the multiple connection points 22 on the cage's upper bars 21. As illustrated in FIG. 8, the mounting devices 18 are secured to the existing pad in a similar manner as was described for the composite pad 11, although the aforementioned fasteners 19 may be replaced by alternative fasteners 29 that are better suited for use with the composition of the existing pad 28. The sides of the mounting features 18 are fully enclosed by retaining sleeves 30 that allow the mounting devices 18 to nest inside, thereby preventing the lower bars 20 from moving side to side. The retaining sleeves 30 are secured to the mounting devices 18 with security fasteners 31 to prevent the two from being easily disconnected. The composition and functionality of the assembled security cage 20-27 is unchanged from that which was previously described.

While we have shown and described several embodiments in accordance with the present invention, it should be understood that the same are susceptible to further changes and modifications by one skilled in tis art given the disclosure herein. Therefore, we do not intend to be limited to the details shown and described herein but intend to cover all such changes and modifications as are encompassed by the scope of the appended claims.

We claim:

1. A utility pad arrangement for mounting equipment thereon, comprising a flat, plate-like pad body having at least four recesses around a periphery thereof, and at least four mounting devices, each of the mounting devices being configured to nest within each of a respective one of the recesses and constituting a security cage comprised of assembleable strap-shaped bars configured so as to be insertable into and removable from respective ones of the mounting devices only upon disassembly of the bars to deter unauthorized removal of the security cane in its assembled, locked configuration, wherein the at least four mounting devices include at least one threaded fastener arranged so as to be inaccessible with the bars in their assembled state after insertion into the respective ones of the mounting device.

2. The utility pad arrangement of claim 1, wherein the pad body is composed of a molded lightweight composite material.

3. The utility pad arrangement of claim 1, wherein an upper surface of the pad body upon which equipment is to be mounted has a textured, non-skid top surface.

4. The utility pad arrangement of claim 1, wherein an underside of the pad body contains at least one recess for ballast material to be secured therein.

5. The utility pad arrangement of claim 1, wherein the pad both has a horizontal flange that extends outwardly at least partially around a lower perimeter thereof.

6. The utility pad arrangement of claim 1, wherein the mounting devices are configured to allow adjustability at least one of length and width of the security cage to optimally conform to a length and width of the equipment mounted on the pad body.

7. The utility pad arrangement of claim 1, wherein the bars are composed of high strength material including solid steel.

8. The utility pad arrangement of claim 1, wherein the bars are configured to be securely affixed together in a central junction with a locking mechanism.

9. The utility pad arrangement of claim 1, wherein each of the mounting devices contains a rectangular slot sized to accommodate the strap-shaped bars and is oriented at an acute angle with respect to an upper surface of the pad body so as to frustrate removal of the bars from the pad body in their assembled state.

10. The utility pad arrangement of claim 1, wherein each of the at least four strap-shaped bars is comprised of two members arranged on a respective one of at least four sides of a unit held securely within the security cage.

11. A security cage arrangement for an existing utility pad body, comprising an assembly of at least four strap-shaped bars configured so as to be insertable into and removable from respective ones of at least four mounting devices configured to be retrofitted to the existing utility pad body so that each of the strap-shaped bars is insertable into and removable from respective ones of the mounting devices only upon disassembly of the bars to deter unauthorized removal of the security cage in its assembled, locked configuration, wherein the at least four mounting devices include at least one threaded fastener arranged so as to be ones of the mounting device and a respective sleeve-shaped member configured to surround each of the mounting devices to prevent lateral movement of the bars out of the mounting devices.

12. The security cage arrangement of claim 11, wherein each of the mounting devices contains a rectangular slot sized to accommodate the strap-shaped bars and is oriented at an acute angle with respect to an upper surface of the pad body so as to frustrate removal of the bars from the pad body in their assembled state.

13. The security cage arrangement of claim 11, wherein each of the at least four strap-shaped bars is comprised of two members arranged on a respective one of at least four sides of a unit held securely within the security cage.

* * * * *